United States Patent [19]

Shimamiya et al.

[11] Patent Number: 4,639,066

[45] Date of Patent: Jan. 27, 1987

[54] CONNECTOR APPARATUS FOR A PRINTED CIRCUIT BASE BOARD

[75] Inventors: Yukio Shimamiya, Machida; Kinzo Narumo, Ichikawa; Hiroshi Ebihara, Tokyo, all of Japan

[73] Assignee: Honda Tsushin Kogyo Kabushiki Kaisha, Tokyo, Japan

[21] Appl. No.: 713,990

[22] Filed: Mar. 20, 1985

[30] Foreign Application Priority Data

Jan. 23, 1985 [JP] Japan ..... 60-6731[U]

[51] Int. Cl.[4] ..... H01R 9/09

[52] U.S. Cl. ..... 339/132 B; 339/17 LC; 339/91 R

[58] Field of Search ..... 339/17 R, 17 L, 17 LC, 339/125, 128, 132, 134, 198 R, 221 R, 221 M, 263 R, 14 R, 91 R

[56] References Cited

U.S. PATENT DOCUMENTS 3,723,950 3/1973 Lovrenich ..... 339/198 R
3,975,076 8/1976 Shida et al. ..... 339/125 R

FOREIGN PATENT DOCUMENTS 3203531 10/1983 Fed. Rep. of Germany .... 339/17 L

OTHER PUBLICATIONS

IBM Bulletin, Meiboom, vol. 5, No. 5, p. 26, 10-1962.
IBM Bulletin, Kinney et al, vol. 17, No. 9, p. 2531, 2-1975.

*Primary Examiner*—Neil Abrams
*Attorney, Agent, or Firm*—Birch, Stewart, Kolasch & Birch

[57] ABSTRACT

A connector apparatus wherein a connector member includes an insulation material connector body with a large number of contacts projecting downwardly from the connector member base for positioning on a printed circuit base board. An attaching member is provided for attaching the contacts to the printed circuit board. An end portion of each of the contacts is connected by soldering to a printed circuit of the base board. The attaching member includes a metallic plate member provided at its one end portion with a pair of legs including projections positioned at forward ends respectively for engagement with and for soldering to the printed circuit base board. The metallic plate member may be provided on both side edges with a pair of engaging claws which engage an inner wall of an attaching opening made in the connector body. The attaching member may include the metallic plate member and a tap screw which is screwed into a second end portion of the metallic plate member.

7 Claims, 13 Drawing Figures

CONNECTOR APPARATUS FOR A PRINTED CIRCUIT BASE BOARD

BACKGROUND OF THE INVENTION

1. Field of the Invention

This invention relates to an electric connector apparatus wherein an electric connector member is mounted on a printed circuit base board.

2. Description of Background Art

As for an apparatus of this kind, there has been hitherto known a connector as shown in FIG. 1, for instance, wherein a connector member A including an insulation material connector body b having a large number of contacts a projecting downwards therefrom is positioned on a printed circuit base board e and is attached thereto through an attaching member comprising a screw c and nut d. An end portion of each of the contacts a is connected by soldering f to a printed circuit on the printed circuit base board e. The conventional apparatus is also provided with a metallic shell g covering the connector body b which is electrically connected to an earth line of the printed circuit base board e through the attaching member, that is the screw c and the nut d. Another connector member B of the male type, for instance, is detachably coupled to an upper surface of the connector member A and is prevented from coming off therefrom by a clamp arm h which projects from the connector member A through a pivot support member i. The connector member B is in engagement with an engaging groove j of a metallic shell k of the connector member B.

However, the conventional connector is inconvenient in that it takes too much time and trouble to attach the connector member to the printed circuit base board. In addition, it is not always easy to obtain a good reliable electric connection between the attaching member and the earth line of the printed circuit base board, because the electric connection is obtained by a pressure contact between the nut d and the earth line thereof.

SUMMARY AND OBJECTS OF THE INVENTION

The present invention has for its object to provide an apparatus free from the inconveniences of the conventional connector. A connector member comprising an insulation material connector body includes a large number of contacts projecting downwardly therefrom is positioned on a printed circuit base board and is attached thereto through an attaching member. An end portion of each of the contacts is connected by soldering to a printed circuit of the base board. The present invention includes an attaching member comprising a metallic plate member which is provided at its one end portion with a pair of legs having at their forward ends respective projections which are to be in engagement with and be soldered to the printed circuit base board.

Further scope of applicability of the present invention will become apparent from the detailed description given hereinafter. However, it should be understood that the detailed descrition and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
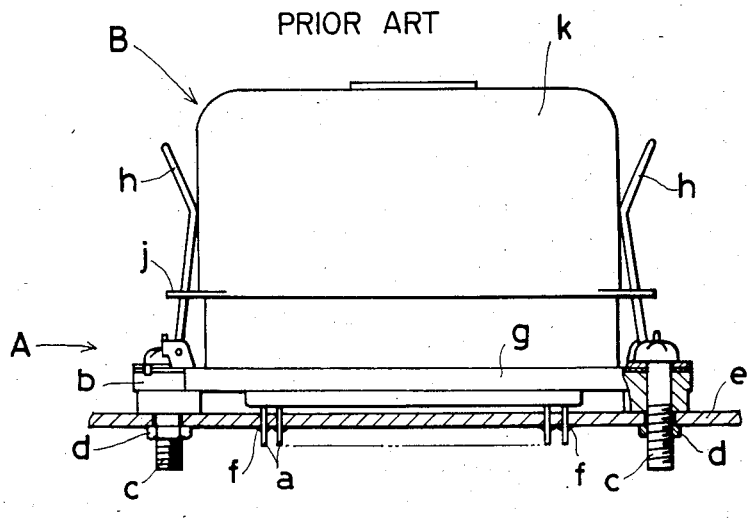
FIG. 1 PRIOR ART
FIG. 1 is a front view, partly in section, of a conventional connector apparatus.

Referring to FIGS. 2–7 showing one example thereof, a connector member A of a female type, for instance, comprising an insulation material connector body 1 having a large number of contacts 4 projecting downwards therefrom. Another connector member B of the male type, for instance, is detachably coupled to a rear side surface of the connector member A.

The connector member A is provided on its rear side surface with a metallic clamp arm 2 attached thereto through a pivot support member 3. The clamp arm 2 is in engagement with an engaging groove v of a metallic shell s of the connector member B to prevent the connector member B from coming off. Each of the contacts 4 is bent at its upper portion to extend rearwardly.

The connector member A is positioned on a print circuit base board 13 and is attached thereto through an attaching member 6. A lower end of each of the contacts 4 projects downwards through an opening made in the printed circuit base board 13 and is connected by solder 16 to the base board 13 in order to be mechanically connected thereto and electrically connected to a printed circuit thereof.

Figure 7:
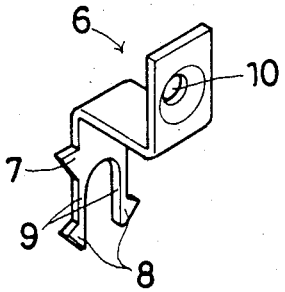
FIG. 7 is a perspective view of a metallic plate member used therein.

The attaching member 6 comprises, as shown clearly in FIG. 7, a metallic plate member which is provided at its one end portion with a pair of legs 9, 9 having at their forward ends respective projections 8, 8 which engage with and are soldered to the printed circuit base plate 13. In more detail, as shown clearly in FIG. 6, the two legs 9, 9 are inserted through an opening 15 made in the base board 13 so that the projections 8, 8 may protrude downward therefrom. The projections 8, 8 are soldered to the base board 13 in order to mechanically connected thereto and be electrically connected to an earth line thereof.

Additionally, the metallic plate member 6 is provided on both side edges with engaging claws 7, 7 which engage with an inner wall of an attaching opening 5 made in the connector body 1. In more detail, as shown clearly in FIG. 6, the engaging claws 7, 7 are forced to bite in the inner wall of the attaching opening 5. Thereby, the metallic material member 6 is fixedly attached to the connector body 1.

In this embodying example, the metallic plate member 6 is elongated through an intermediate bent portion and includes a second end portion thereof. The second end portion thereof is provided with a conical recess portion formed by pressing and an opening 10 is provided in a bottom wall thereof. As shown clearly in FIG. 5, the second end portion thereof is positioned so as to face the foregoing pivot support member 3 through a rear side wall of the connector body 1. A tap screw 12 inserted through an opening of the pivot support member 3 and an attaching opening 11 made in the wall of the connector body 1 is forced to screw at its forward end into the foregoing opening 10 in order to be fastened thereto. Thus, the pivot support member 3 is mechanically fixed to the connector body 1 and is electrically connected to the metallic plate member 6.

Figure 2:
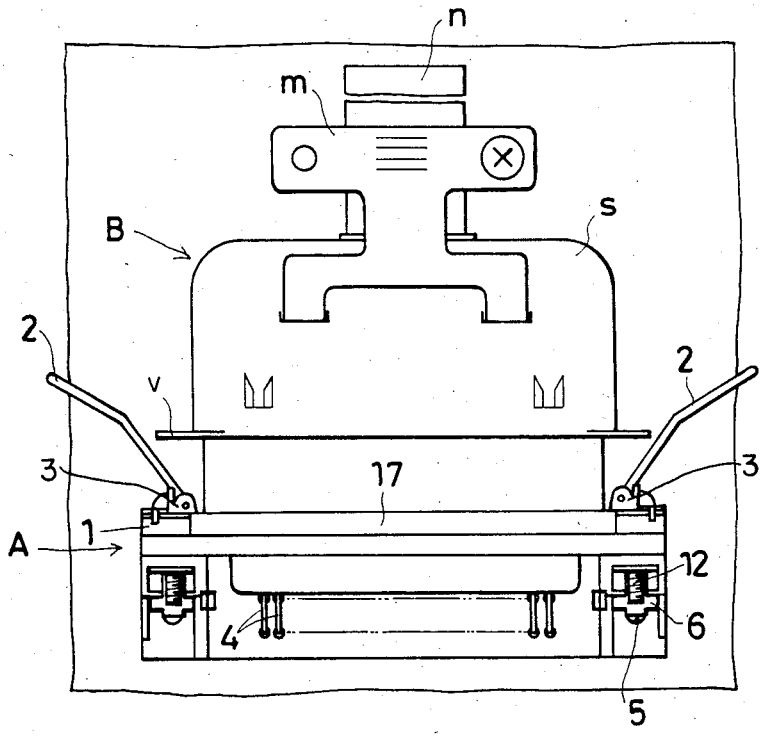
FIG. 2 is a top plan view of a first embodying example of the present invention.
Figure 3:
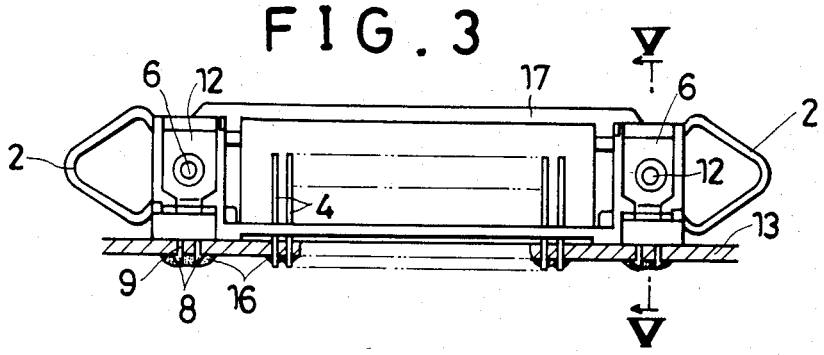
FIG. 3 is a front view, partly in section, of the present invention.
Figure 4:
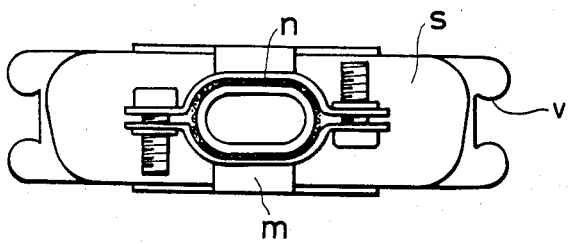
FIG. 4 is a rear side view of a connector member illustrated in FIG. 2.
Figure 5:
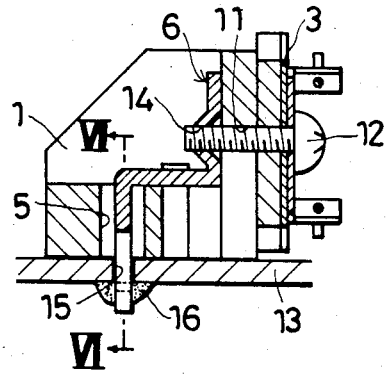
FIG. 5 is a sectional view taken along the line V—V in FIG. 3.
Figure 6:
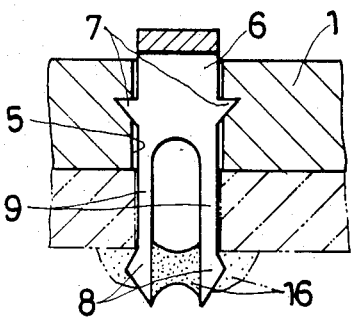
FIG. 6 is a sectional view taken along the line VI—VI in FIG. 5.

As shown clearly in FIGS. 2 and 4, a metallic shell s of the connector member B is provided with a cable holder m for holding a cable n and for electrically connecting an earth connector of the cable n to the metallic shell s. A metallic shell 17 of the connector member A is provided therearound.

In order to attach the connector member A to the printed circuit base board 13, as a first step, the lower end portion of each of the contacts 4 is inserted through the opening 14 of the base board 13. At the same time, the two legs 9, 9 of the one end portion of the metallic plate member 6 are inserted, against the resilient property thereof, through the opening 15 of the base board 13 and the projections 8, 8 of the two legs 9, 9 protrude outside from the bottom surface of the base board 13 in order to be in engagement with the edge portion of the opening 15. Thus, the connector member A is temporarily fixed onto the printed circuit base board 13. Thereafter, the end portions of the contacts 4 and the forward end portions of the two legs 9, 9, which protrude downwards from the base board 13 are, respectively, soldered 16, by a flow soldering process wherein a molten solder is spouted upwards to form a convex surface flow and the base board is moved to pass over the solder, to the base board 13 in order to be mechanically fixed to the base board 13 and be electrically connected to the printed circuit and the earth line formed on the surface of the base board 13.

Thus, the connector member A is firmly attached to the printed circuit base board 13. This connection forms an earth circuit of small electric resistance between the earth line of the base board 13 and the pivot support member 3 through the metallic plate member 6 and the tap screw 12.

The engaging portion between the metallic plate member 6 and the tap screw 12 can be comparatively large in length even if the metallic plate member 6 is comparatively small in thickness, because the opening 10 is made in the bottom wall of the conical recess portion formed by pressing. In other words, a comparatively large number of screw threads can be formed in the opening 10, and consequently there can be secured reliable electric and mechanical connections therebetween even where a thin metallic plate member 6 is used.

Figure 8:
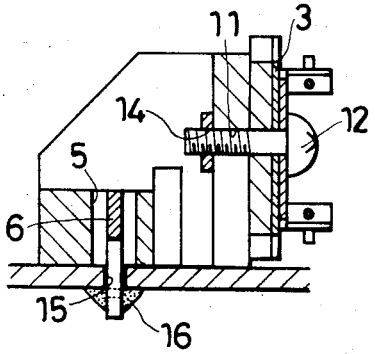
FIG. 8 is a sectional view, similar to FIG. 5, in a second embodying example of the present invention.
Figure 9:
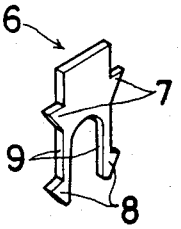
FIG. 9 is a perspective view of a metallic plate member used therein.
Figure 10:
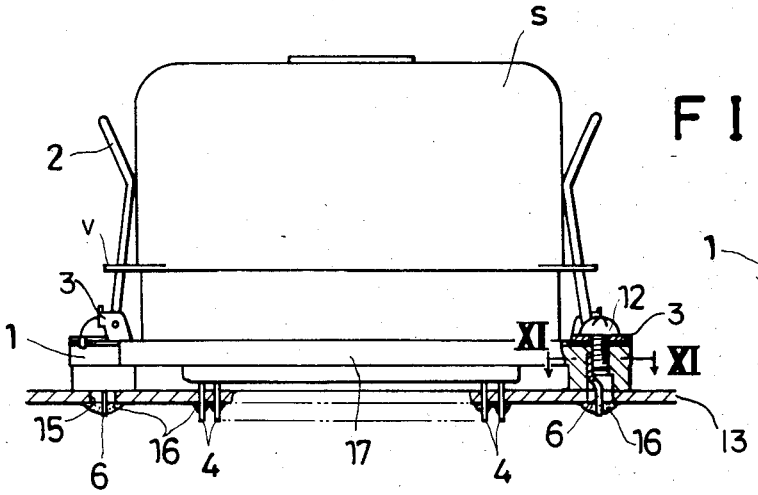
FIG. 10 is a front view, partly in section, of a third embodying example of the present invention.
Figure 11:
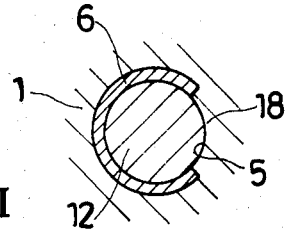
FIG. 11 is a sectional view taken along the line XII—XII in FIG. 10.
Figure 12:
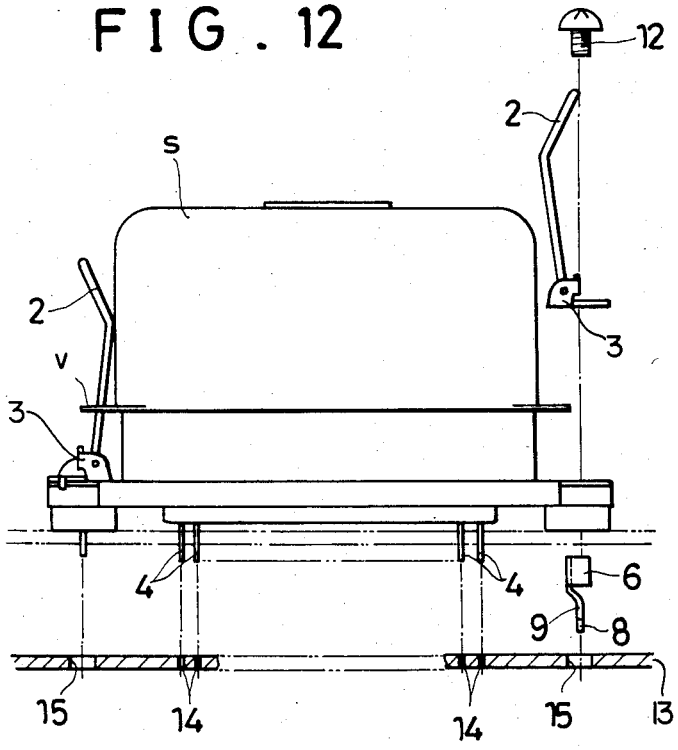
FIG. 12 is a front view, partly disassembled, of the embodiment illustrated in FIG. 10.
Figure 13:
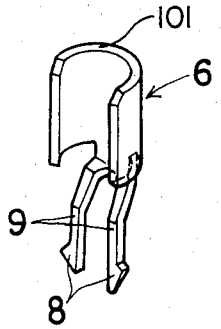
FIG. 13 is a perspective view of a metallic plate member used therein.

FIGS. 8 and 9 show a second embodying example of the present invention. In the foregoing example, the metallic plate member 6 has been used to also serve as an earth conductor. In the second embodying example, however, the metallic plate member 6 is used exclusively as an attaching member. Namely, the connector member A is fixed to the printed circuit base board 13 only through the metallic plate member 6. The other constructions of the second embodying example are not especially different from those in the foregoing embodying example.

FIGS. 10–13 show a third embodying example of the present invention. In this example, the metallic plate member 6 is of a type such that it is inserted at its other end portion from below into the attaching opening 5 of the connector body 1 before being placed on the base board 13. The second end portion thereof is formed into a curved, arc shape 101 in section, as shown clearly in FIG. 13. The tap screw 12 inserted through the opening of the pivot support member 3 and the attaching opening 5 of the connector body 1 is forced to be screwed into the curved portion, whereby the pivot support member 3 and the metallic plate member 6 are fixed in relationship to the connector body 1 and at the same time the two members 3, 6 are interconnected electrically.

In order to prevent the metallic plate member 6 from turning during the operation when the tap screw 12 is being screwed thereinto, there is provided in the inner wall of the attaching opening 5 a positioning projection 18 mounted in a space formed between the opposite side edges of the curved portion of the metallic plate member 6 inserted in the opening 5.

Thus, in almost the same manner as in the foregoing example, the connector member A is firmly attached to the printed circuit base board 13. An earth circuit of small electric resistance is formed between the earth line of the base board 13 and the pivot support member 3, through the metallic plate member 6 and the tap screw 12.

Thus, according to this invention, the attaching member comprises a metallic plate member which is provided at its one end portion with a pair of legs having at their forward ends respective projections. The projections are arranged to be in engagement with and soldered to the printed circuit base board, so that attaching of the connector member to the printed circuit base board can be carried out easily and rapidly. In this manner, a good mechanical connection between the attaching member and the printed circuit base board and a good electrical connection between the attaching member and the earth line of the printed circuit base board may be obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A connector apparatus comprising:

a connector member including an insulation material connector body;

a large number of contacts projecting downwardly from said connector member body for positioning on a printed circuit base board;

an attaching member for attaching said connector member to said printed circuit base board;

an end portion of each of the contacts is connected by soldering to a printed circuit of the base board;

said attaching member comprises a metallic plate member with first and second opposite end portions and provided at the metallic plate member first end portion with a pair of legs including projections positioned at forward ends respectively for engagement with and for soldering to the printed circuit base board;

said attaching member including a tap screw which is screwed into a second end portion of the metallic plate member to clamp the connector member to the printed circuit base board;

said second end portion of the metallic plate member is formed into a curved portion of an arc shape in section and the tap screw is screwed into the curved portion.

2. An apparatus according to claim 1, and further including a pivot support member operatively connected to said attaching member and said connector body for providing an electrical interconnection therebetween when said tap screw is affixed to said metallic plate member.

3. An apparatus according to claim 1, and further including a positioning projection formed in a space between opposite side edges of the curved portion of said metallic plate member for preventing the turning of said metallic plate member as said tap screw is secured thereto.

4. An apparatus according to claim 1, wherein the arc shape of the metallic plate member extends a predetermined distance from said second end portion towards said first end portion.

5. An apparatus according to claim 1, and further including a pivot support member operatively connected to said connector member, said tap screw retaining said pivot support member and said connector member on said printed circuit board and for providing an electrical interconnection between said pivot support member and an electrical ground connection of said circuit board when said tap screw is affixed to said metallic plate member.

6. A connector apparatus comprising:

a connector member including an insulation material connector body;

a large number of contacts projecting downwardly from said connector member body for positioning on a printed circuit base board;

an attaching member for attaching said connector member to said printed circuit base board;

an end portion of each of the contacts is connected by soldering to a printed circuit of the base board;

said attaching member comprises a metallic plate member with first and second opposite end portions, said metallic plate member first end portion is provided for engagement with and for soldering to the printed circuit base board;

said attaching member including a tap screw which is screwed into the second end portion of the metallic plate member for clamping the connector member to the printed circuit base board;

said second end portion of the metallic plate member is formed into a curved portion of an arc shape in section defining a slot in the curved portion, said tap screw is screwed into the curved portion;

said connector member body including a hole within which said second end portion of said metallic plate member is received, said connector member body including a projection located within said hole for engaging said slot of said second end portion of said metallic plate member for preventing the rotation of said attaching member upon screwing said tap screw into said attaching member during attaching said connector apparatus to said printed circuit base board.

7. An apparatus according to claim 6, wherein the arc shape of the metallic plate member extends a predetermined distance from said second end portion towards said first end portion.

* * * * *